US005405207A

United States Patent [19]

Zubli

[11] Patent Number: 5,405,207

[45] Date of Patent: Apr. 11, 1995

[54] VOICE PEN FOR GENERATING AUDIBLE MESSAGES

[76] Inventor: Leslie A. Zubli, Apple Gift Corp., 329 Old Court Rd., New Hyde Park, N.Y. 11040

[21] Appl. No.: 95,683

[22] Filed: Jul. 23, 1993

[51] Int. Cl.[6] ..... B43K 29/00

[52] U.S. Cl. ..... 401/110; 401/195; 362/118

[58] Field of Search ..... 401/195, 52, 110; 446/404; 362/118

[56] References Cited

U.S. PATENT DOCUMENTS

| | | | |
|---|---|---|---|
| 4,768,040 | 8/1988 | Pipkin et al. | 401/195 |
| 4,812,068 | 3/1989 | Seong | 401/195 |
| 4,934,079 | 6/1990 | Hoshi | 446/404 X |
| 5,115,472 | 5/1992 | Park et al. | 446/404 X |
| 5,174,440 | 12/1992 | Chiu | 401/52 X |
| 5,251,112 | 10/1993 | Chen | 401/195 X |

FOREIGN PATENT DOCUMENTS

| | | | |
|---|---|---|---|
| 47379 | 3/1982 | European Pat. Off. | 401/195 |
| 3505944 | 8/1986 | Germany | 401/195 |
| 2127754 | 4/1984 | United Kingdom | 401/195 |

*Primary Examiner*—Danton D. DeMille
*Attorney, Agent, or Firm*—Robert E. Bushnell

[57] ABSTRACT

A voice pen comprises: a housing, an applying ink part, a part for retracting and extending the ink applying part; and an audio module for reproducing an audible message in response to extension of ink applying part. More specifically, extension and retraction of the ink applying part is provided by a function shaft and holder. This function shaft also activates a switch of the voice module that initiates the reproduction of the audible message.

6 Claims, 2 Drawing Sheets

VOICE PEN FOR GENERATING AUDIBLE MESSAGES

SCOPE OF THE INVENTION

The present invention relates writing implements generally and, more particularly, to an audio pen that, upon extension of a ball point, generates an audible message.

BACKGROUND OF THE INVENTION

Standard pen designs can be modified to convey information such as advertising messages. In the past, these advertising messages have been conveyed visually, on the barrel of the pen. This technique, however, suffers from a number of disadvantages. First, any message written on the barrel of the pen is obscured by a user's hand during operation. Therefore, the message is not conveyed to the user during this time. Secondly, the medium is entirely passive. That is, the user only will receive the advertising message if he/she actively undertakes to read the message. Thirdly, the medium lacks any novelty. The public has become so familiar with this type of advertising that it is naturally ignored. Therefore, conventional techniques for incorporating an advertising message into pens are inadequate.

A solution to some of the above-identified problems is disclosed in U.S. Pat. No. 5,086,577 to Abernethy. Here, an advertising device is attached to a push-button of a pen. The advertising device includes a number of planar faces on which advertising indicia may be affixed. Although this invention moves the advertising message off the pen barrel and additionally provides a certain degree of novelty, the invention destroys the balancing of the pen while increasing the pen's overall length and width. Further, the advertising device is easily detachable by a user who simply might not want to deal with the lack of convenience associated with the advertising device.

SUMMARY OF THE INVENTION

It is an object of this invention to provide an improved pen-type advertising device.

It is another object of this invention to provide a pen which includes an audio processing device.

According to the principles of the present invention, a voice pen comprises: a housing, an applying ink part, a part for retracting and extending the ink applying part; and a audio module for reproducing an audible message in response to extension of ink applying part. More specifically, extension and retraction of the ink applying part is provided by a function shaft and holder. This function shaft also activates a switch of the audio module that initiates the reproduction of the audible message.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

The inventive voice pen includes a hollow lower cab 10 which forms a lower section of an outer housing of the pen. The lower cab 10 is substantially cylindrically shaped in a center and top portion. A lower portion of the lower cab 10 has a tapered section that ends with an opening. An upper end of the lower cab 10 ends in a lower cab threaded portion 12.

Figure 1:
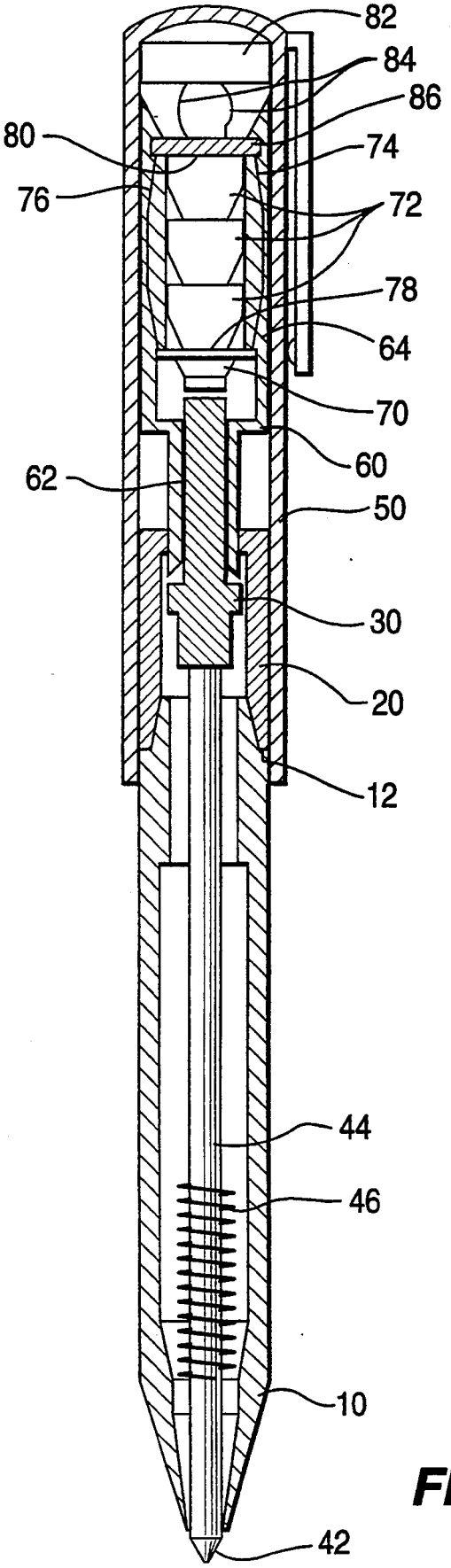
FIG. 1 is a cut-away view of the inventive voice pen.
Figure 2:
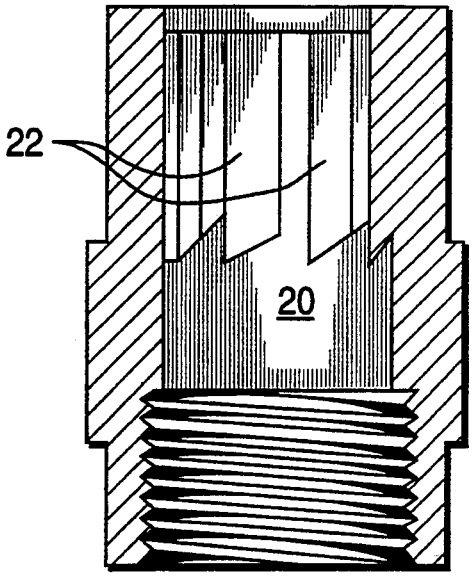
FIG. 2 is a cut-away view of the function shaft holder.

A hollow function shaft holder 20 is rigidly connected with the lower cab 10 via the lower cab threaded portion 12. As shown in the detailed cut-away view of the function shaft holder 20 of FIG. 2, a plurality of raised tracks 22 are formed on inner walls of the function shaft holder which extend in an axial direction from an upper end to approximately a midpoint of the function shaft holder.

Figure 3:
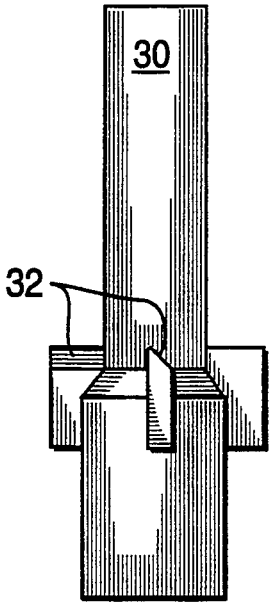
FIG. 3 is an external view of the function shaft.

A function shaft 30 is substantially contained within the function shaft holder 20. As shown in the detailed view of the function shaft 30 of FIG. 3, a center portion of the function shaft has a plurality of guides 32 which ride between the raised tracks 22 to provide for two axial position operation relative to the function shaft holder 20. That is, the function shaft has two stable positions, a first position in which the guides 32 are seated on a lower end of the raised tracks 22 and a second position in which the guides 32 are seated between the raised tracks 22 of the function shaft holder 20.

A ball point nib 42 is connected to and receives ink from a long cylindrical ink containing tube 44. The ball point nib 42 and ink containing tube 44 are disposed inside of the lower cab 10 and extend from a lower end of the function shaft 30 to the opening in the lower cab 10. A compression spring 46 is positioned between the ink containing tube 44 and the lower cab 10 to urge the top of the ink containing tube against the lower end of the function shaft 30. Consequently, translation of the function shaft 30 from its second position to its first position causes the ball point nib 42 to be extended out the opening in the lower cab 10, whereas translation of the function shaft 30 from its first position to the second position causes the ball point nib 42 to be retracted into the opening.

A hollow upper cab 50 forms an upper section of the outer housing of the pen. The upper cab 50 is substantially cylindrically shaped in a center and bottom portion. A lower end of the upper cab 50 is open exposing a smooth inner bore of the upper cab. The top portion of the upper cab, however, has a dome shaped closed end. The smooth inner bore slidably receives the function shaft holder 20 and the upper portion of the lower cab 10.

Figure 4:
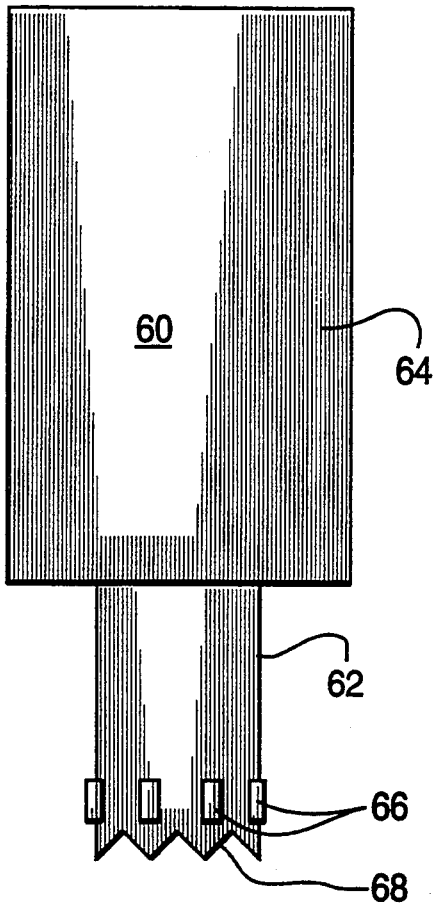
FIG. 4 is an external view of the audio module housing.

A audio module housing 60 is securely positioned inside the upper cab 50 just below the dome shaped closed end. The audio module housing 60 has a small diameter lower section 62 extending down from a large diameter upper section 64. As shown in the detailed view of the module housing 60 of FIG. 4, the small diameter lower section 62 has a plurality of rectangular protrusions 66 on an outer surface that are adapted to ride between the raised tracks 22 of the function shaft holder 20 to prevent twisting of the upper cab 50 relative to the lower cab 10. A serrate terminal end 68 of the small diameter lower section 62 is adapted to cooperate with the guides 32 of the function shaft 30 to rotate the function shaft 30 during translation from the second position to first position so that the function shaft 30 will become seated on a lower end of the raised tracks 22 such that each depression of the upper cab relative to the lower cab causes the ball point nib 42 to be successively extended and retracted.

A rubber switch 70 is securely fixed inside of large diameter upper section 64 of the audio module housing 60. This rubber switch 70 is activated by a portion of the function shaft 30 that extends upwardly inside of the small diameter lower portion 62. More specifically, extension of the ball point nib 42 by depressing of the upper cab causes the function shaft to be forcibly urged against the rubber switch 70 thereby overcoming the resiliency of the rubber switch 70 and causing the activation of the rubber switch. Alternatively, the rubber switch 70 can be replaced by a leaf switch.

Three batteries 72 are series connected and stacked above the rubber switch 70 inside of the large diameter upper section 64. Above the stacked batteries 72, a printed circuit board 86 having an audio processing circuit is securely fixed inside of large diameter upper section 64 of the audio module housing 60. A negative terminal 80 of the stacked batteries 72 is continually connected to the printed circuit board 86. A positive terminal 78 of the stacked batteries 72 is also continually connected printed circuit board 86 via a first electrode 74. The first electrode is seated within the side walls of the large diameter upper section 64 and extends between the positive terminal 78 and the printed circuit board. A second electrode 76 is connected between the printed circuit board 86 and rubber switch 70 to intermittently provide a conductive path between the positive terminal 78 and the circuit board 86 in response to the depression of the rubber switch 70 by the function shaft 30. The second electrode 76 is likewise seated within the side walls of the large diameter upper section 64 of the audio module housing 60.

A piezo electric transducer 82 is securely positioned inside of the upper cab 50 just below the domed shaped closed end thereof. Two leads 84 of the transducer 82 are connected to the printed circuit board 86 to receive amplified analog signals from the printed circuit board 86. The amplified analog signals are converted by the transducer into audio signals.

Figure 5:
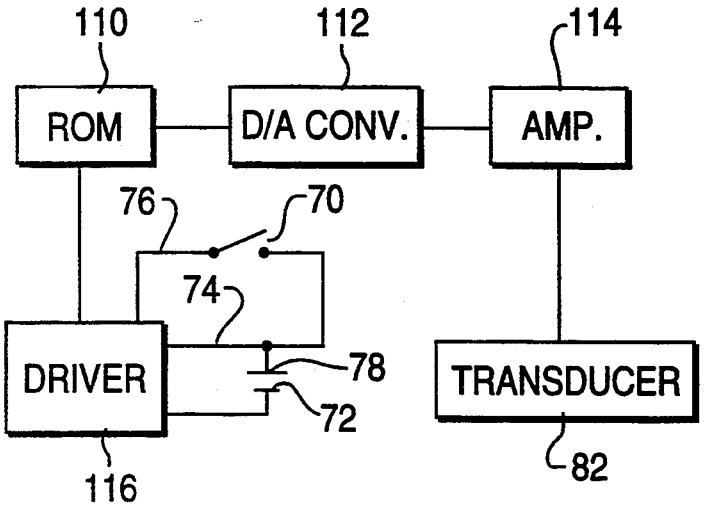
FIG. 5 is a block diagram of the audio processing circuit.

FIG. 5 shows a block diagram of the audio processing circuit of the printed circuit board 86, the rubber switch 70, and the batteries 72. The audio processing circuit includes a driver 116, a Read-Only-Memory (ROM) 110, an digital-to-analog converter 112, and an amplifier 114. Activation of the rubber switch 70 connects the positive terminal 78 to the driver 116 of the printed circuit board 86 via the second electrode 76. The transient application of the voltage via the second electrode 76 causes the driver 116 to enable the ROM 110 to provide digital signals to the digital-to-analog converter 112. The digital-to-analog converter converts the digital signals to analog signals that are then amplified by the amplifier 114. The amplifier 114 generates the amplified analog audio signals that are received by the transducer 82.

The audio signals generated by the transducer 82 can be a spoken advertisement, for example. Alternatively, a song could be generated. Further, with appropriate modifications to the audio processing circuit, provisions can be made for storage as well as playback of audio signals. For example, the transducer could further perform the functions of a microphone that would convert received audio signals into received analog audio signals. These received analog audio signals could be converted to digital signals and stored in a random access memory provided in place of the ROM 110.

Although the present invention has been described and illustrated in detail above, it is clearly understood that the same is by way of illustration and example only and is not to be taken by way of limitation. The spirit and scope of the present invention is limited only by the terms of the appended claims.

I claim:

1. A voice pen, comprising:

a lower cap containing means for applying ink;

a function shaft holder, securely attached to the lower cap, said holder having a plurality of raised tracks on an inner surface;

an upper cap, having a smooth inner bore for slidably receiving said function shaft holder and an upper portion of said lower cap;

function shaft means, abutting against the ink applying means, said function shaft means having a plurality of raised protrusions on an outer surface engaging said raised tracks on said function shaft holder to maintain said ink applying means in a position extended from said lower cap while said function shaft means is in a first axial position with respect to said tracks, and to permit said ink applying means to retract into a position within said lower cap while said function shaft means is in a second axial position;

a speaker;

audio module means electrically coupled to said speaker, for reproducing an audible message;

a switch adapted to electrically trigger broadcast of said audible message when said function shaft means is forcibly urged against said switch in response to depression of said upper cap;

a housing positioned within said upper cap and supporting said switch wholly within said housing while supporting said audio module means within and stationary relative to said upper cap, said housing having a first portion maintaining a first pole of a source of electrical energy in continuous electrical contact with said audio module means while maintaining a second pole of the source in continuous electrical contact with said switch, and having a first lead providing an electrical connection between said audio module means and said switch;

said housing maintaining the source, said audio module means and said speaker, spaced apart from and separated by said switch from said function shaft means;

said housing having a hollow second portion for internally receiving an end portion of said function shaft means and guiding said end portion forcibly against said switch in response to said depression of said upper cap; and said second portion having a serrated periphery for rotating said function shaft means between said first and second axial positions to accommodate sequential movement of said ink applying means between said extended and retracted positions in response to successive occurrences of said depression of said upper cap.

2. A voice pen as claimed in claim 1, wherein said audio module means further comprises:

a read only memory for storing digital data and producing digital signals, digital to analog conversion means for converting said digital signals to analog signals, driver means for driving said read only memory to produce said digital signals; and said switch providing a transient signal for activating said driver in dependence upon said audio module means being placed in electrical contact with said second pole via said switch.

3. A voice pen as claimed in claim 2, wherein said switch comprises a leaf switch.

4. A voice pen as claimed in claim 2, wherein said switch comprises a rubber switch.

5. A voice pen as claimed in claim 1, comprising said second portion of said housing having a plurality of raised protrusions on an outer surface thereof for engaging said raised tracks on said function shaft holder to prevent twisting of said upper cap relative to said lower cap.

6. A voice pen as claimed in claim 1, comprising said housing having a second lead electrically connecting said second pole of said source of electrical energy with said audio module means independently of said switch, and wherein said switch provides only a transient electrical connection between said second pole of said source and said audio module means.

* * * * *